US005820527A

United States Patent [19]

Lai

[11] Patent Number: 5,820,527

[45] Date of Patent: Oct. 13, 1998

[54] HEIGHT ADJUSTING DEVICE FOR BABY WALKERS

[76] Inventor: Jui Hsing Lai, No. 177, Li-Sing Road, Sung-Ming District, Kaoshiung, Taiwan

[21] Appl. No.: 955,926

[22] Filed: Oct. 22, 1997

[51] Int. Cl.[6] ..... A62B 7/06; A47D 13/04

[52] U.S. Cl. ..... 482/68; 247/5; 280/647

[58] Field of Search ..... 297/136, 56, 49, 297/340, 344.12, 344.13, 344.15, 5, 449; 108/146, 153; 248/229, 230; 280/647, 644, 650

[56] References Cited

U.S. PATENT DOCUMENTS

| | | | |
|---|---|---|---|
| 3,534,935 | 10/1970 | Gunn | 108/146 |
| 4,433,869 | 2/1984 | Payne, Jr. et al. | 297/5 |
| 4,576,392 | 3/1986 | Quinlan, Jr. | 297/56 |
| 4,723,813 | 2/1988 | Kassai | 297/149 |
| 4,759,541 | 7/1988 | Chen | 482/68 |
| 4,850,644 | 7/1989 | Kazaoka et al. | 297/452.18 |
| 5,324,064 | 6/1994 | Sumser et al. | 482/68 |
| 5,564,724 | 10/1996 | Huang | 482/68 |

*Primary Examiner*—Jerome Donnelly
*Attorney, Agent, or Firm*—Rosenberg, Klein & Bilker

[57] ABSTRACT

A baby walker includes a chassis with casters mounted to an underside thereof and an upper frame having a seat mounted thereon. The upper frame further includes two racks mounted to an underside thereof. Two pairs of cross-hinged first beams and second beams are mounted between the chassis and the upper frame. Two engaging members are respectively, slidably mounted to the racks. A connecting beam which interconnects upper ends of the first beams has two ends respectively connected to the engaging members to move therewith. A pawl is pivotally mounted to each engaging member and is biased to engage with one of a number of teeth formed on the associated rack. An actuating rod has two ends respectively, securely attached to the two pawls to move therewith.

3 Claims, 10 Drawing Sheets

HEIGHT ADJUSTING DEVICE FOR BABY WALKERS

BACKGROUND OF THE INVENTION

1. Field of the Invention

The present invention relates to a height adjusting device for baby walkers.

2. Description of the Related Art

A typical baby walker is illustrated in FIGS. 8 to 10 of the drawings and includes a chassis 10 with casters 101 mounted to an underside thereof, two pairs of cross-hinged beams 20 and 30, and an upper frame 4. Lower ends of the beams 20 and 30 are pivotally attached to the chassis 10, and upper ends of the beams 30 are securely attached to the upper frame 4 at 301. The upper frame 4 includes a seat 402 having openings 401 defined therein through which a baby's legs may extend. In addition, two positioning plates 5 (FIG. 9) are respectively mounted to an underside of the upper frame 4 adjacent to upper ends of the beams 20. Two retaining devices 6 are provided for respectively, releasably attaching the upper ends of the beams 20 to the positioning plates 5. As shown in FIGS. 9 and 10, each retaining device 6 includes an arcuate plate 601 having an end releasably engaged with one of a number of spaced slots 501 defined in the associated positioning plate 5, and an engaging member 602 having an end securely attached to the arcuate plate 601 and a pair of hooks 603 for slidingly engaging with two lateral sides of the associated positioning plate 5. A connecting beam 201 interconnects upper ends of the beams 20 and includes two ends of which are respectively, securely received in the engaging members 602 (FIG. 10). In use, if adjustment of the baby walker is required, each arcuate plate 601 is pressed to disengage from the slot 501 of the associated positioning plate 5 to thereby allow sliding movements of the engaging member 602 along the positioning plate 5. The beams 20 are thus lowered or elevated to a required level while each arcuate plate 601 is engaged with another slot 501 of the associated positioning plate 5 as soon as the arcuate plate 601 is released. Nevertheless, the number of the slots 501 defined in the positioning plate 5 is limited as the length of the positioning plate 5 is limited. Accordingly, height adjustment of the baby walker is limited. In addition, since the beams 20 are connected to the frame 40 by means of engagements between the engaging members 602 and the positioning plates 50, the connecting beam 201 may bend as being subjected to a force when a baby sits on the seat 402.

The present invention aims to provide an improved height adjusting device for baby walkers which mitigates and/or obviates the above problems.

SUMMARY OF THE INVENTION

A baby walker in accordance with the present invention comprises a chassis with casters mounted to an underside thereof and an upper frame having a seat mounted thereon. The upper frame further includes two racks mounted to an underside thereof, each rack having a plurality of teeth formed thereon. Two pairs of cross-hinged first beams and second beams are mounted between the chassis and the upper frame, wherein each of the first beams and the second means has a lower end pivotally attached to the chassis, each of the second beams has an upper end securely attached to the upper frame, and each of the first beams has an upper end interconnected by a connecting beam.

Two engaging means are respectively, slidably mounted to the racks. The connecting beam has two ends respectively connected to the engaging means to move therewith, and a pawl is pivotally mounted to each engaging means. An actuating rod has two ends respectively, securely attached to the two pawls to move therewith. And means are provided for biasing each pawl to engage with one of the teeth of the associated rack.

By such an arrangement, when adjustment of the height of the seat is required, the actuating rod is pulled to cause the pawls to disengage from the teeth of the racks to allow sliding movements of the engaging means along the racks. The height of the seat is lowered or elevated to a desired level for the baby, and the actuating rod is then released while each pawl engages with another tooth of the associated rack under the action of the biasing means.

Preferably, both the actuating rod and the connecting beam may include an arcuate section at a mediate portion thereof to prevent from being actuated by the baby's legs.

Other objects, advantages, and novel features of the invention will become more apparent from the following detailed description when taken in conjunction with the accompanying drawings.

DESCRIPTION OF THE PREFERRED EMBODIMENT

Figure 1:
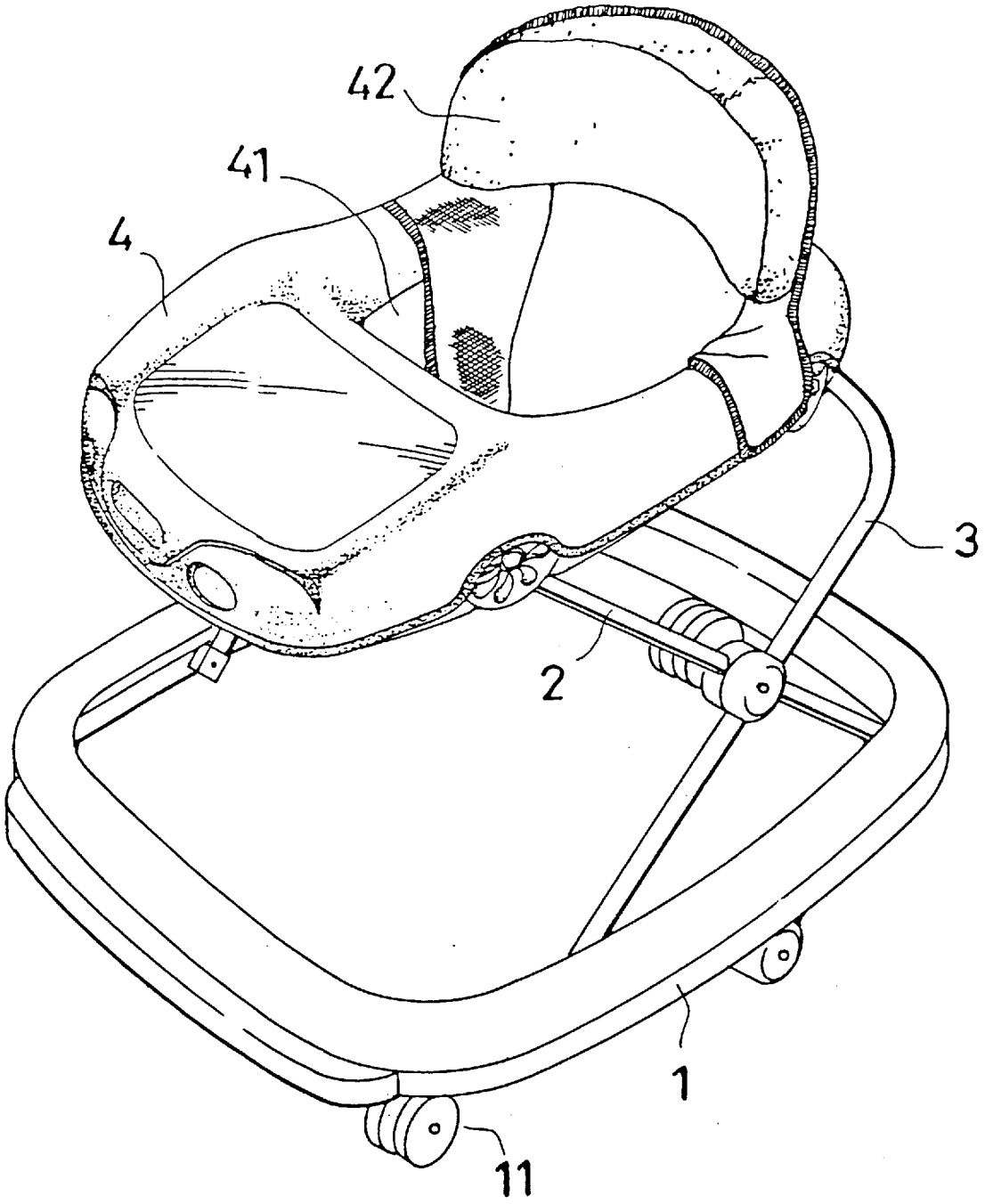
FIG. 1 is a perspective view of a baby walker in accordance with the present invention.

Referring to FIGS. 1 to 7 and initially to FIG. 1, a baby walker generally includes a chassis 1 with casters 11 mounted to an underside thereof, two pairs of cross-hinged beams 2 and 3, and an upper frame 4. Lower ends of the beams 2 and 3 are pivotally attached to the chassis 1, and upper ends of the beams 3 are securely attached to the upper frame 4. The upper frame 4 includes a seat 42 having openings 41 defined therein through which a baby's legs may extend.

Figure 2:
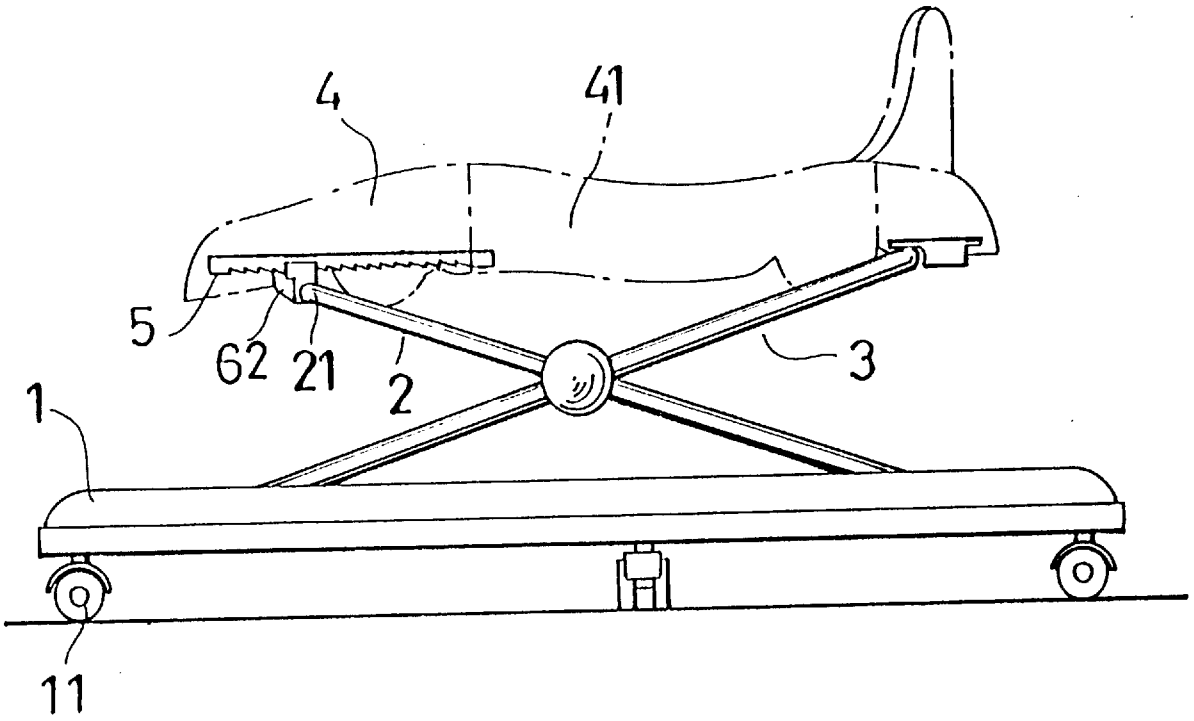
FIG. 2 is a side view of the baby walker in accordance with the present invention.
Figure 3:
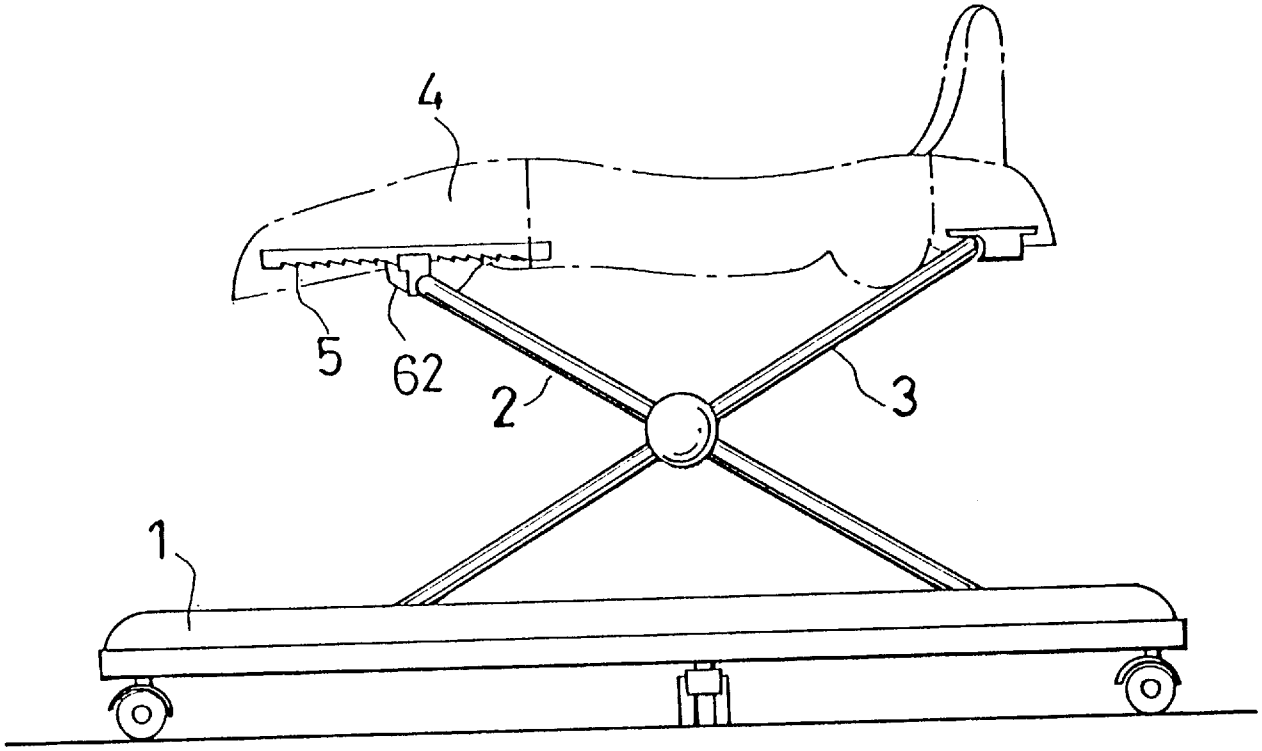
FIG. 3 is a view similar to FIG. 2, wherein the seat of the baby walker is elevated.
Figure 4:
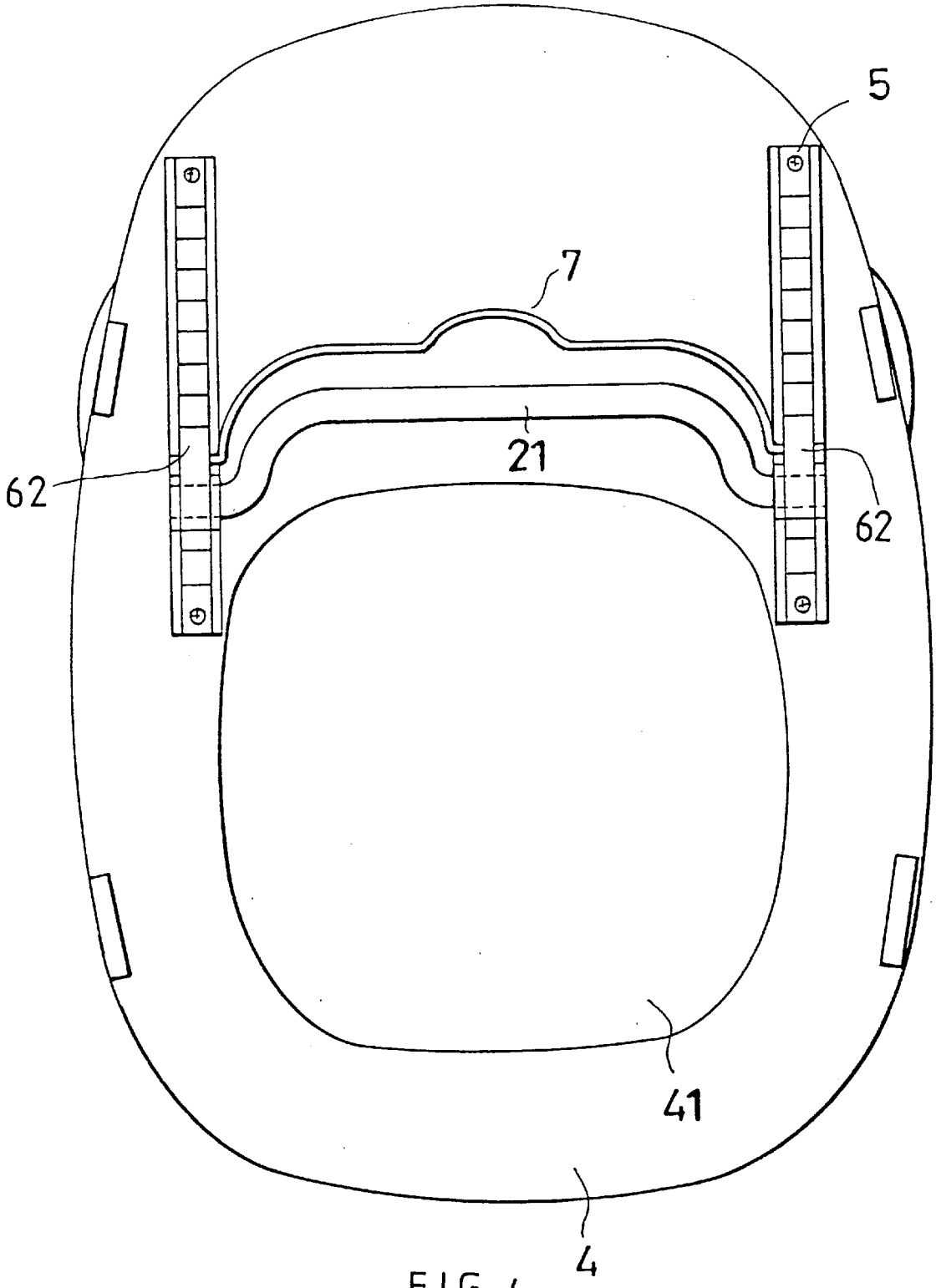
FIG. 4 is a plane view of an underside of an upper frame of the baby walker in accordance with the present invention.
Figure 5:
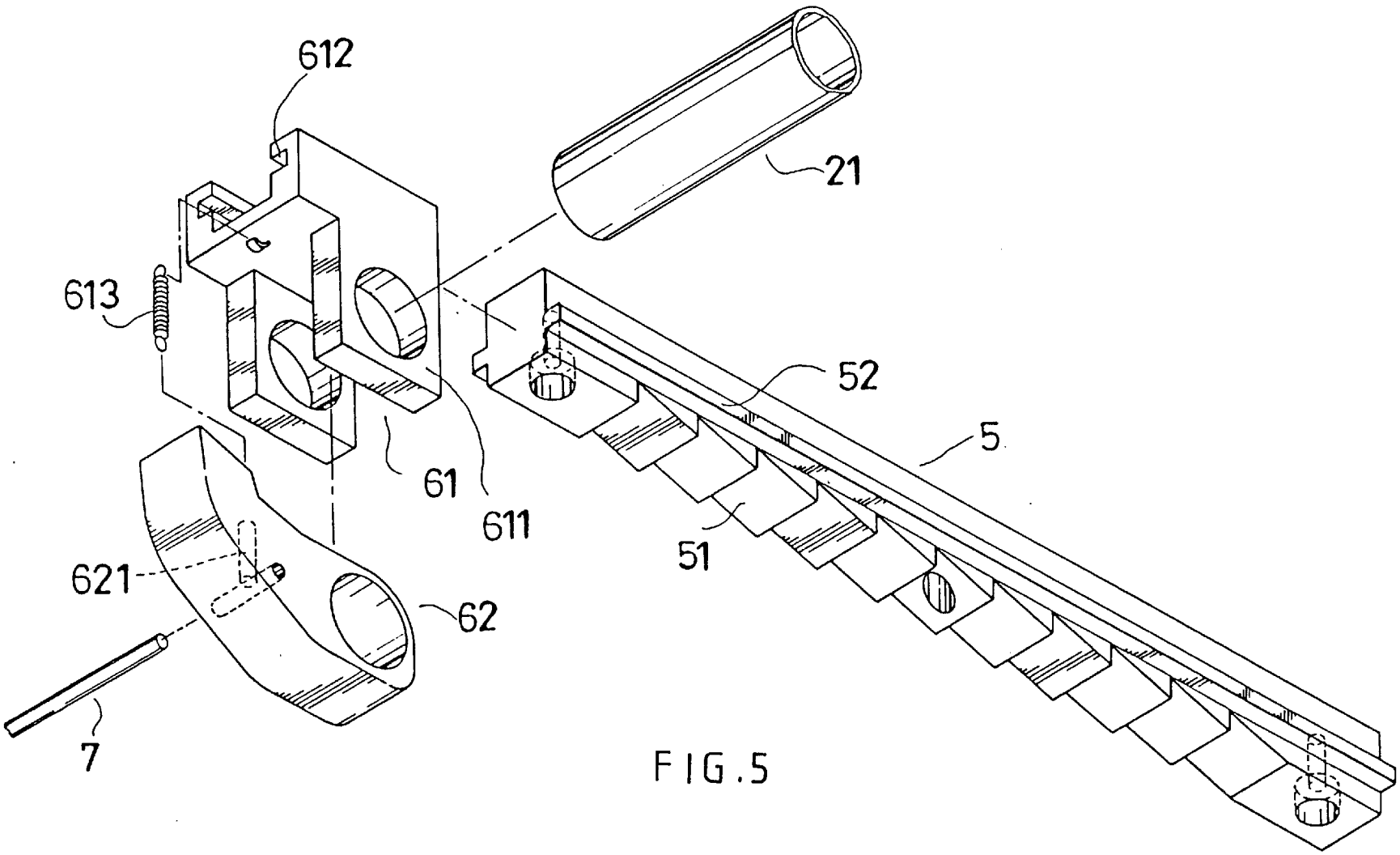
FIG. 5 is an exploded view illustrating a height adjusting device in accordance with the present invention.

Referring to FIGS. 2 to 4, two positioning racks 5 are mounted to an underside of the upper frame 4 and adjacent to a connecting beam 21 which interconnects upper ends of the beam 2 (i.e., the upper ends of the beams 2 constitute two ends of the connecting beam 21). Referring to FIGS. 2, 4, and 5, each rack 5 includes a number of teeth 51 formed thereon and two lateral wings 52. An engaging means 61 is slidably mounted to each rack 5 by means of a guiding groove 612 slidably receiving the lateral wings 52. The engaging means 61 further includes a pair of lugs 611 for pivotally receiving a pawl 62, and an end of the connecting beam 21 extends through the lugs 611 and the pawl 62. In addition, an elastic member 613 includes a first end attached to the engaging means 61 and a second end received in a compartment 621 defined in the pawl 62 to bias the pawl 62 to engage with one of the teeth 51 of the associated rack 5. Further, an actuating rod 7 has two ends respectively, securely attached to the two pawls 62 to move therewith.

Figure 6:
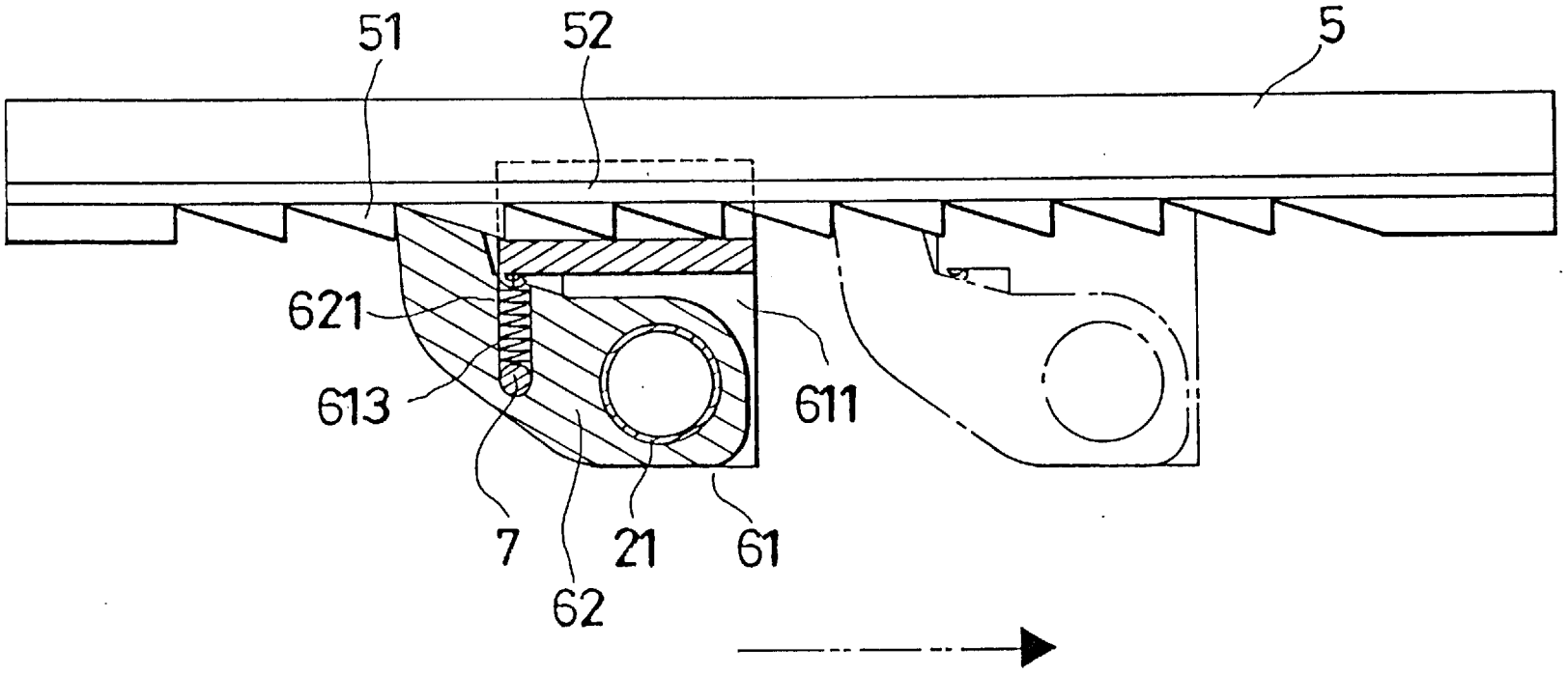
FIGS. 6 and 7 are side views, partially sectioned, illustrating adjustment of the height of the baby walker in accordance with the present invention.
Figure 7:
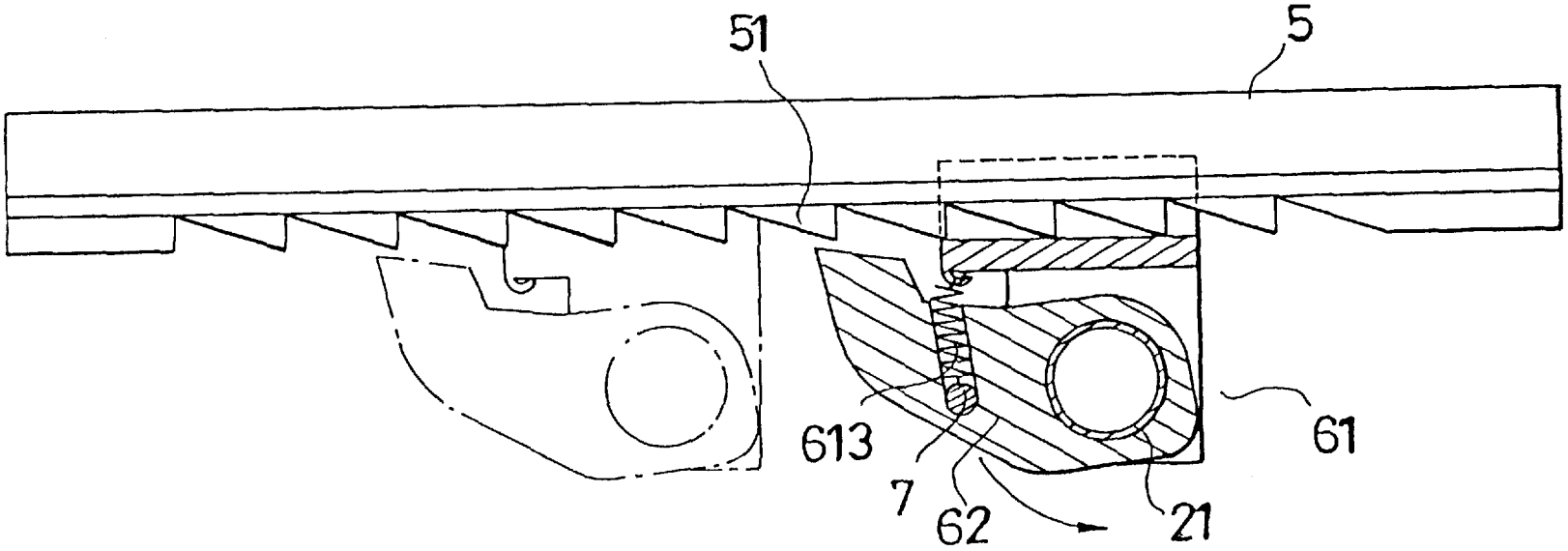
Figure 8:
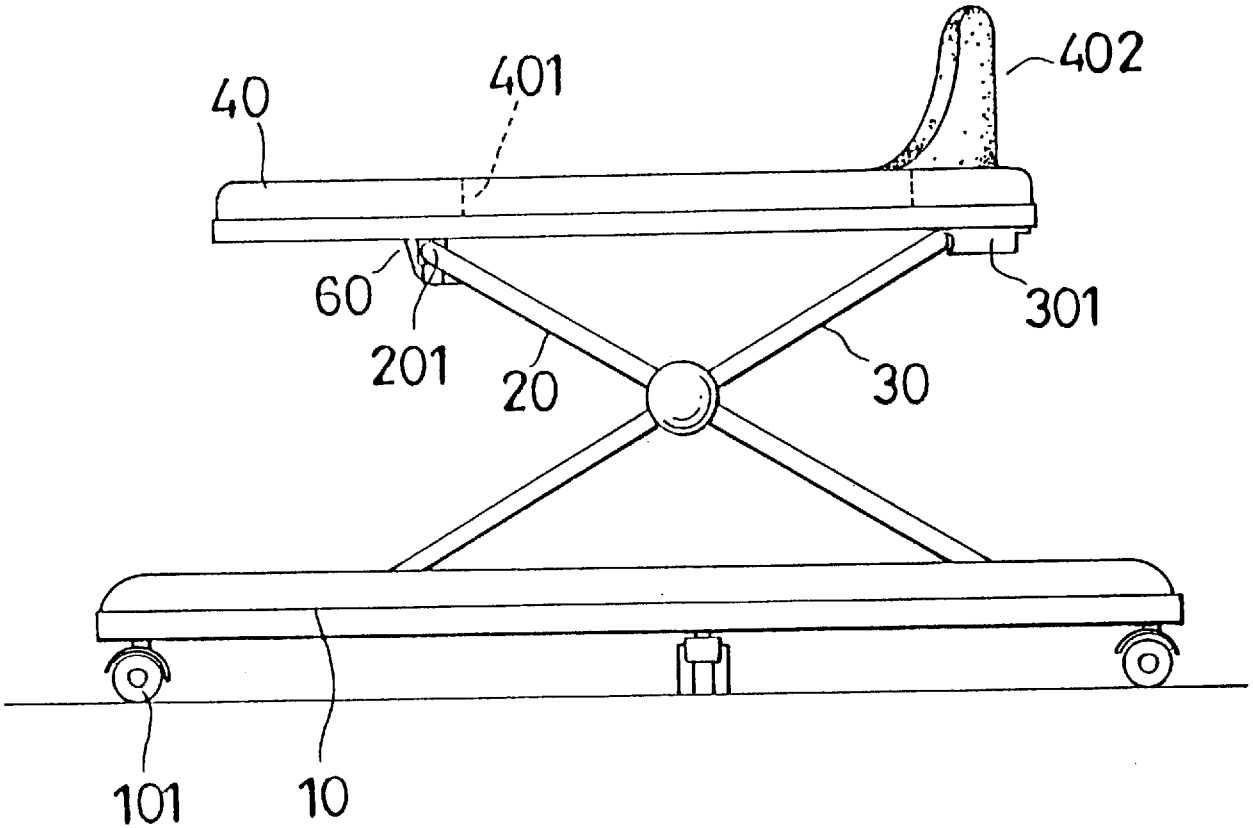
FIG.8 PRIOR ART
FIG. 8 is a side view of a prior art baby walker.
Figure 9:
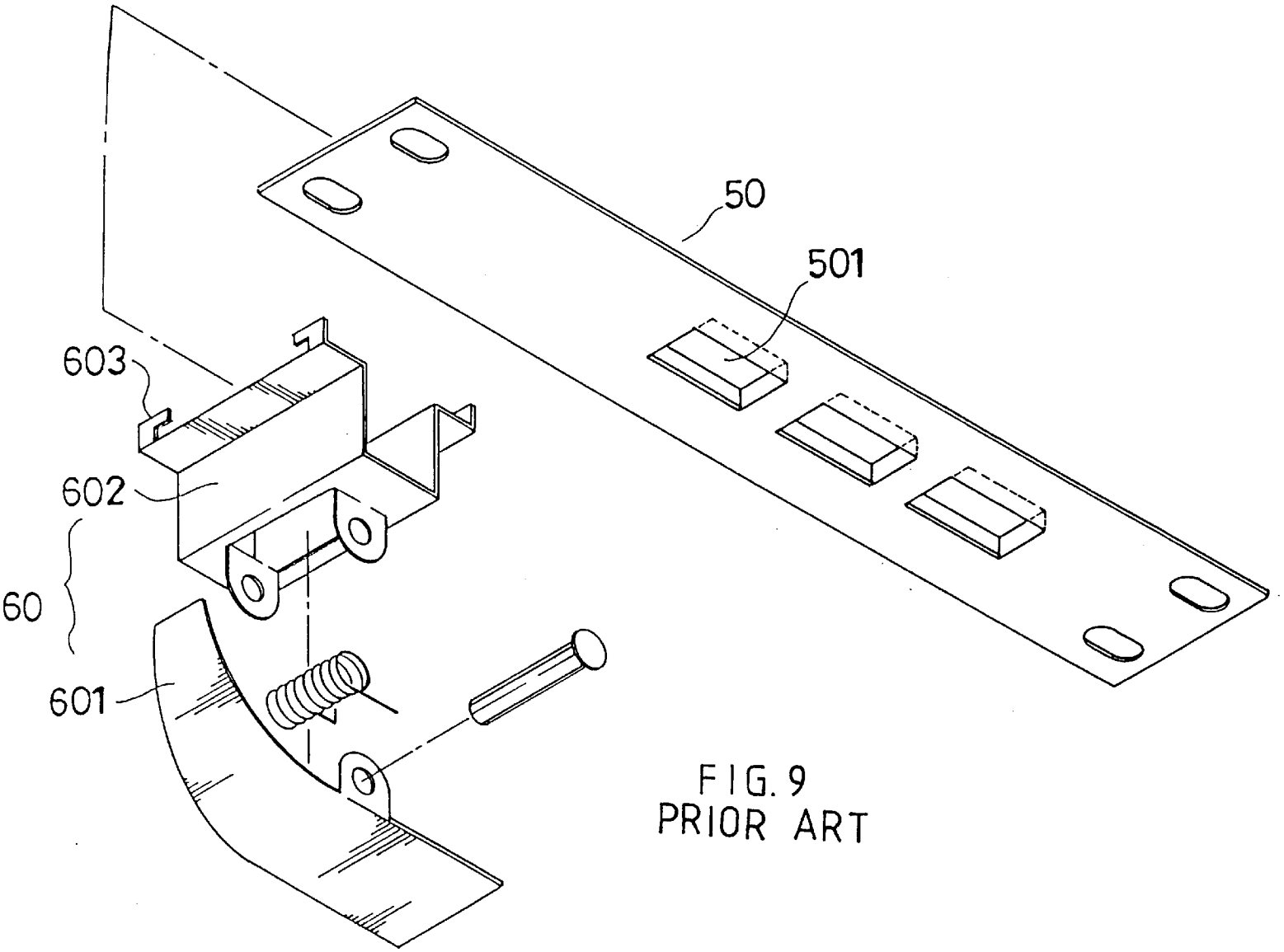
FIG. 9 PRIOR ART
FIG. 9 is an exploded perspective view illustrating a prior art height adjusting device for baby walkers.
Figure 10:
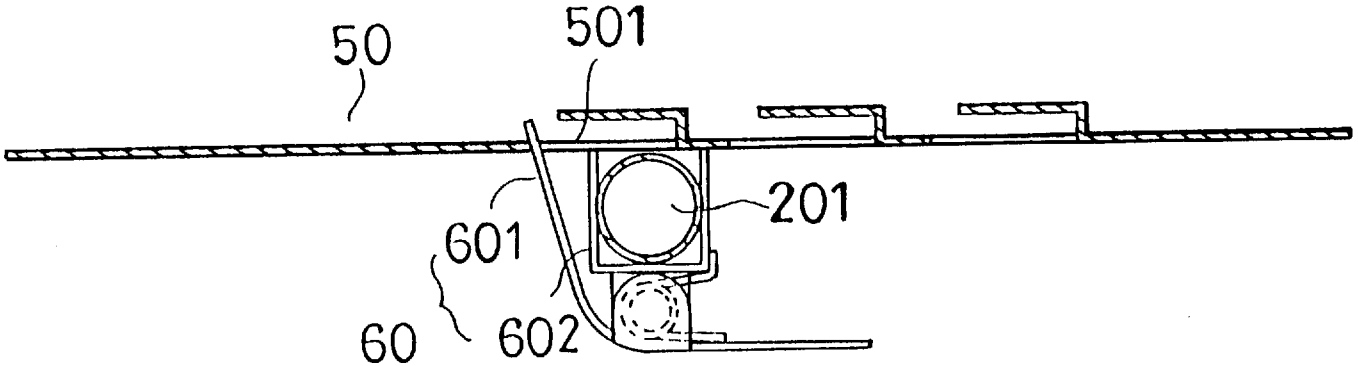
FIG. 10 PRIOR ART
FIG. 10 is a sectional view of the prior art height adjusting device.

In use, when the seat 42 mounted to the upper frame 4 is too low and should be elevated, the actuating rod 7 is pulled to cause the pawls 62 to disengage from the teeth 52 of the racks 5 to allow sliding movements of the engaging means 61 along the racks 5 (from right to left, see FIG. 6). The height of the upper frame 4 is elevated to a desired level for the baby (see FIG. 3), and the actuating rod 7 is then released while each pawl 62 engages with another tooth 51 of the associated rack 5 under the action of the elastic member 613. Similarly, when the seat 42 is too high, the actuating rod 7 is pulled to cause the pawls 62 to disengage from the teeth 52 of the racks 5 to allow sliding movements of the engaging means 61 along the racks 5 (from left to right, see FIG. 7). The height of the upper frame 4 is lowered to a desired level for the baby (see FIG. 2), and the actuating rod 7 is then released while each pawl 62 engages with another tooth 51 of the associated rack 5 under the action of the elastic member 613. Preferably, both the actuating rod 7 and the connecting beam 21 may include an arcuate section at a mediate portion thereof (FIG. 4) to prevent from being actuated by the baby's legs.

It is appreciated that the rack 5 may have many teeth 51 thereon to allow minor adjustment of the height of the seat 42 for the baby, and operation thereof is easy and simple. In addition, a downward force exerting by the upper frame 4 may be uniformly distributed to two ends of the connecting beam 21 to thereby prevent deformation of the connecting beam 21.

Although the invention has been explained in relation to its preferred embodiment, it is to be understood that many other possible modifications and variations can be made without departing from the spirit and scope of the invention as hereinafter claimed.

What is claimed is:

1. A baby walker, comprising:

a chassis with casters mounted to an underside thereof, an upper frame having a seat mounted thereon, the upper frame further including two racks mounted to an underside thereof, each said rack having a plurality of teeth formed thereon two pairs of cross-hinged first beams and second beams, each of said first beams and second means having a lower end pivotally attached to the chassis, each of said second beams having an upper end securely attached to the upper frame, each of said first beams having an upper end interconnected by a connecting beam, two engaging means respectively, slidably mounted to said racks, said connecting beam having two ends respectively connected to said engaging means to move therewith, a pawl being pivotally mounted to each said engaging means, an actuating rod having two ends respectively, securely attached to the two pawls to move therewith; and means for biasing each said pawl to engage with one of the teeth of the associated rack.

2. The baby walker according to claim 1, wherein the connecting beam includes an arcuate section formed at a mediate section thereof.

3. The baby walker according to claim 1, wherein the actuating rod includes an arcuate section formed at a mediate section thereof.

* * * * *